US006130660A

United States Patent [19]

Imsand

[11] Patent Number: 6,130,660

[45] Date of Patent: Oct. 10, 2000

[54] SYSTEM AND METHOD FOR SYNTHESIZING HIGH RESOLUTION VIDEO

[75] Inventor: Bruce E. Imsand, Huntsville, Ala.

[73] Assignee: MaxVision Corporation, Madison, Ala.

[21] Appl. No.: 08/130,552

[22] Filed: Oct. 1, 1993

[51] Int. Cl.[7] ..... G09G 5/00

[52] U.S. Cl. ..... 345/132; 345/213

[58] Field of Search ..... 345/132, 213; 348/448, 911, 441, 458, 445

[56] References Cited

U.S. PATENT DOCUMENTS

| | | | |
|---|---|---|---|
| 4,866,520 | 9/1989 | Nomura et al. | 358/140 |
| 4,935,731 | 6/1990 | Takebe et al. | 340/814 |
| 4,975,636 | 12/1990 | Desautels | 345/132 X |
| 5,031,118 | 7/1991 | Morizot | 345/132 |
| 5,051,928 | 9/1991 | Gruters | 364/521 |
| 5,073,965 | 12/1991 | Konishi et al. | 345/132 X |
| 5,119,082 | 6/1992 | Lumeisky et al. | 340/731 |
| 5,124,804 | 6/1992 | Socarras | 358/150 |
| 5,140,315 | 8/1992 | Edelson et al. | 340/728 |
| 5,185,817 | 2/1993 | Degi et al. | 382/47 |
| 5,208,669 | 5/1993 | Richards | 348/445 |
| 5,212,550 | 5/1993 | Park | 348/458 |
| 5,231,490 | 7/1993 | Park | 348/458 |
| 5,231,491 | 7/1993 | Holoch | 348/458 |
| 5,349,385 | 9/1994 | Glenn | 348/458 |

FOREIGN PATENT DOCUMENTS

| | | | |
|---|---|---|---|
| 4003094 | 1/1992 | Japan | 345/132 |
| 0436094 | 12/1992 | Japan | 345/132 |

*Primary Examiner*—Kent Chang

*Attorney, Agent, or Firm*—Burns, Doane, Swecker & Mathis, L.L.P.

[57] ABSTRACT

Systems and methods for transforming low resolution data into higher resolution video signals are disclosed. Exemplary embodiments of the present invention allow fixed frequency monitors to be integrated with personal computers without sacrificing backward compatibility of software which requires many different video display modes.

6 Claims, 11 Drawing Sheets

GRAPHICS PROCESSOR
10
PIXEL CLOCK
VRAM SHIFT CLOCK
VIDEO BLANK
32
HIGH RES. DATA
ADDRESS
CONTROL
VRAM
512K X 32
2 MBYTE
14
32
HIGH RES. VIDEO
RAMDAC
HIGH PERFORMANCE
16
RGB
8
VGA DATA
PROCESSING CIRCUITRY
22
R, G, B VIDEO
H SYNC
V SYNC
CLOCK SELECT
MEMORY CLOCK
FIXED FREQ.
MONITOR
24

| VISIBLE PORTION OF SCAN | FIFO A | HORIZONTAL RETRACE W1 | FIFO B | W2 | ACCUM |
|---|---|---|---|---|---|
| | | 1 | | 0 | 1.84166 |
| DATA LINE | RE-SEND | .841666 | ADVANCE | .15833 | .84166 |
| BLEND | | 0 | RE-SEND | 1 | 1.68333 |
| DATA LINE | ADVANCE | .316667 | RE-SEND | .683333 | .68333 |
| BLEND | RE-SEND | 1 | | 0 | 1.525 |
| DATA LINE | RE-SEND | .525 | ADVANCE | .475 | .525 |
| BLEND | | 0 | RE-SEND | 1 | 1.3666 |
| DATA LINE | ADVANCE | .63333 | RE-SEND | .36666 | .36666 |
| BLEND | RE-SEND | 1 | | 0 | 1.2083 |
| DATA LINE | RE-SEND | .20833 | ADVANCE | .79167 | .20833 |
| BLEND | | 0 | RE-SEND | 1 | 1.05 |
| DATA LINE | ADVANCE | .95 | RE-SEND | .05 | .05 |
| BLEND | RE-SEND | .89166 | ADVANCE | .10833 | .89166 |
| BLEND | | 0 | RE-SEND | 1 | 1.7333 |
| DATA LINE | ADVANCE | .26667 | RE-SEND | .73333 | .73333 |
| BLEND | RE-SEND | 1 | | 0 | 1.575 |
| BLEND | RE-SEND | .575 | ADVANCE | .425 | .575 |
| BLEND | | 0 | RE-SEND | 1 | 1.4166 |
| DATA LINE<br>884 VISIBLE SCAN LINES<br>480 VISIBLE DATA LINES | | | | | |
| | | | | | |
| | | | | | |
| VERTICAL RETRACE & BLANK | | | | | |

Fig. 9

SYSTEM AND METHOD FOR SYNTHESIZING HIGH RESOLUTION VIDEO

BACKGROUND

The present invention generally relates to display and graphic systems and methods and, more particularly, to such systems and methods which can provide visual output for computers.

Today's personal computer market, like so many other successful areas of technology, is a product of evolution and not revolution. IBM compatible personal computers (PCs) have been designed such that software purchased a decade ago will run unmodified on the latest release of computer hardware. Microsoft's DOS operating system has evolved without requiring rewriting of applications purchased or written at the beginning of the PC's history. Likewise, Microsoft's Windows operating system, even though significantly more advanced and functioning on a completely different user interface than DOS, still provides convenient access to the older DOS environment. However, the price that must be paid to maintain this backward compatibility comes in terms of additional software complexity and higher hardware cost.

There has been a long history of evolution of the display controller and display monitors used in IBM compatible PCs. The first and most basic of the display modes used in these devices is known as character mode. A standard originally defined by the MC6845 CRT controller, character mode circuits create an array of fixed sized and fixed font text similar to the text seen in alpha-numeric terminals in the late '70s. The familiar C: prompt is most commonly seen in character mode. In fact most DOS commands and the boot sequence of the PC use character mode. The video sent to the monitor to display text in character mode is a 720 pixels by 400 scan line image. All PCs and display monitors today support this low resolution character mode.

While the requirements for character mode have been constant throughout the history of the PC, bit mapped graphics requirements have evolved continuously. PC bit mapped graphics began with the original Color Graphics Adapter (CGA) and Hercules graphics standards which evolved into the Enhanced Graphics Adapter (EGA) standard and then the Video Graphics Adapter (VGA) standard. There were no significant graphics software applications programming interfaces (APIS) to buffer the software applications from the physical hardware interface in the DOS environment. Thus, every piece of applications software required a different applications device driver for each of the different graphics resolutions and color capability which has evolved.

Today, the PC industry generally accepts the VGA 640×480 pixel resolution graphics mode as the minimum acceptable resolution for running the more sophisticated Microsoft Windows applications. Since Windows does use a standardized applications programming interface (API) for graphics, higher resolutions such as 800×600, 1024×768, and 1280×1024 pixels can be used by simply installing the appropriate Windows graphics device driver. This allows applications software designed for Windows to remain totally independent of the graphics hardware.

If one could simply discard all of the old DOS applications software, the old DOS graphics compatibility hardware problems could simply be ignored in favor of the well structured Windows environment. Since many computer users fear hardware obsolescence and base their purchasing decisions on products having a history of supporting legacies, this has never been allowed to happen. Although the cost of the PC graphics controller has not been adversely affected by this backward compatibility feature, the modem PC display monitor has not been so fortunate.

The CRT display monitor evolution has been much more complicated than that of the graphics industry in general. The PC standard has required the monitor manufacturers to design display monitors which can handle every resolution below their maximum nominal performance. For example, a VGA color monitor in 1989 was required to support not only the 640×480 VGA resolution, but also the EGA 640×350, CGA 320×200, and 720×400 character mode resolutions. These multisync monitors have been required to adapt to nearly any video signal which any graphic controller outputs and produce a quality picture.

Today, the best multisync monitors can adapt to resolutions up to 1600×1200 pixels while still providing adequate image quality in character mode. Microprocessor-based circuitry within the monitor provides the necessary adaptive adjustments and controls, largely sheltering the user from having to make manual adjustments to the monitor as it switches resolutions. This added circuitry is very expensive, particularly in the higher end multisync monitors, when compared to the single frequency monitors used in the workstation markets.

It is important to note that even today, Microsoft's most advanced operating system "WINDOWS NT", requires the display system to begin in character mode while the machine boots and runs its diagnostic software. In today's world the latest DOS applications have settled on the VGA 640×480 resolution as a standard, while the Windows environment generally runs in the highest native resolution supported by the monitor, which can be, for example, from 640×480 to 1280×1024. Thus, the aforementioned complexity problem which has increased the cost of monitors in the PC world shows no signs of abating.

The workstation market and the Apple "MACINTOSH" market have not been plagued by the same problems as the PC market. These markets have not required the use of multisync monitors because of their generally short legacies and well structured graphics device drivers, allowing the applications designed for these systems to be free of any hardware specifics. Typical fixed resolution monitors used by workstation vendors have included, for example, resolutions of: 1024×768, 1152×900, 1184×884, 1280×960 and 1280×1024. These monitors have operated at a fixed screen refresh rate of between 60 and 76 Hz.

Within the context of PC graphics controllers, no low cost means currently exists for real time conversion of low resolution digital video generated by a PC, and synthesizing this video for a fixed scan frequency higher resolution monitor. U.S. Pat. No. 4,866,520 to Nomura et al discloses a system for adapting television signals to CRT displays of computer monitors. Since this patent relates to television signal transformation, however, it fails to recognize the need for, and problems associated with, transforming a plurality of different low resolution computer graphic data modes into a higher resolution video signal. For example, Nomura et al. fails to provide interpolation based on an actual area of coverage or average energy intensity of a data line but instead relies on predetermined selection patterns.

Similarly, U.S. Pat. No. 4,935,731 to Takebe et al. discloses an image display system, and, in particular, a liquid crystal display panel, which transforms signals, but provides an interpolation method using two modulo counters for selecting one of two signals and fails to treat the problems associated with changing horizontal pixel spacing.

SUMMARY OF THE INVENTION

Exemplary embodiments of the present invention do away with the need for multisync monitors by providing superior image quality for low resolution PC modes, such as character mode and VGA, while displaying them on a fixed frequency high resolution monitor. These embodiments transform low resolution data lines into higher resolution scan lines using novel implementations of a nearest neighbor method, color blending method and gamma corrected color blending.

BRIEF DESCRIPTION OF THE DRAWINGS

These and other objects, features and advantages of the present invention will become more apparent when the following detailed description is read in conjunction with the drawings in which:

FIG. 9 is a phase diagram which illustrates the operation of the exemplary embodiment of FIG. 7;

DETAILED DESCRIPTION

Figure 1:
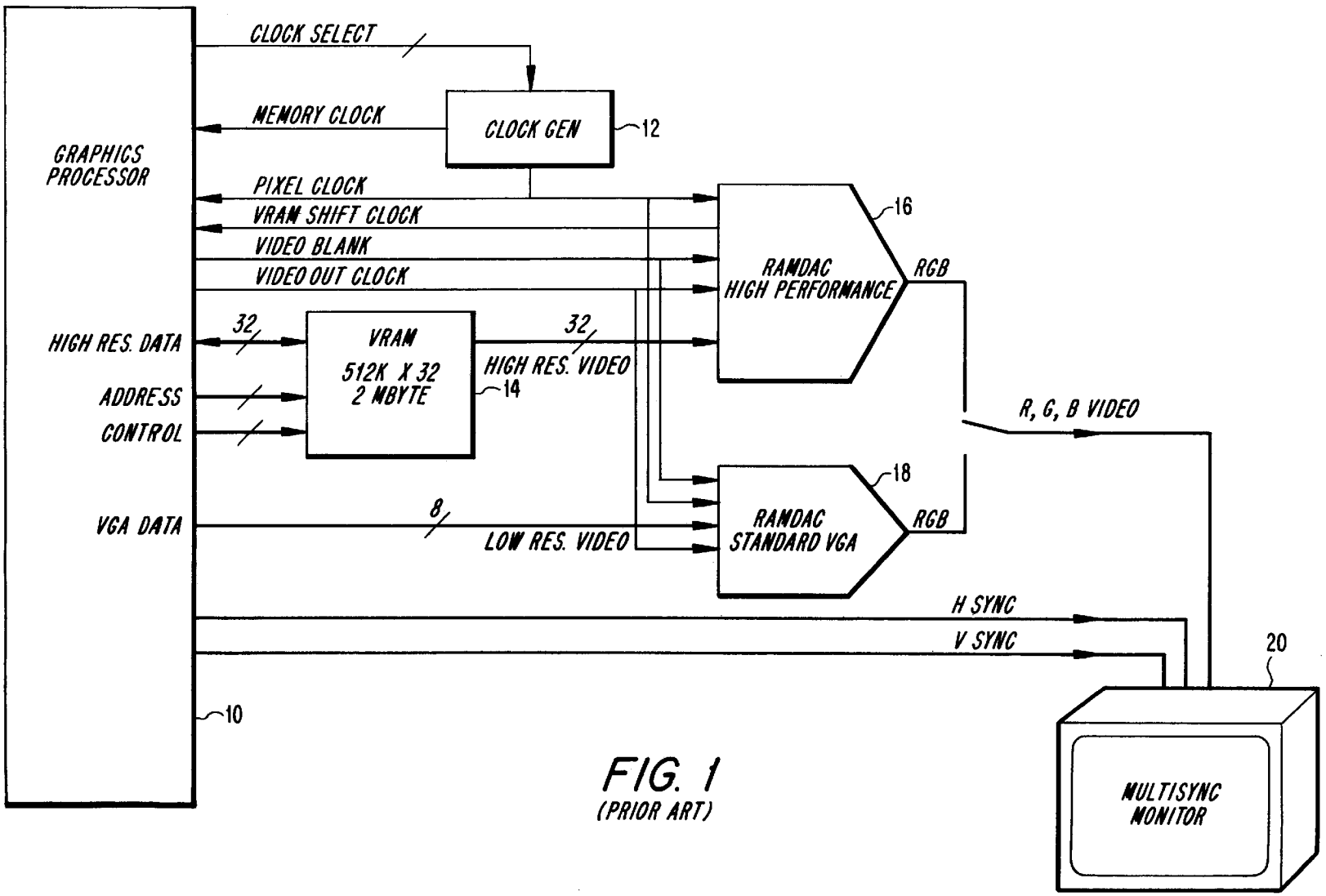
FIG. 1 (PRIOR ART)
FIG. 1 is a general block diagram of a conventional graphics controller/display combination.

FIG. 1 shows a simple block diagram of a conventional modern graphics card. The graphics card includes a graphics processor 10, a clock generator 12, a VRAM array of frame buffer memories 14 and two Video RAMDACs 16 and 18. This graphics processor is typical of, for example, S3 Corporation's 86C928 chip or ATI's Mach 32 chip. In these conventional chips an interface to the microprocessor bus (not shown) allows the PC's microprocessor (not shown) to send, for example, drawing commands, read requests, or write requests to the graphics processor chip 10.

The graphics processor 10 is responsible for responding to all of these types of requests from the host microprocessor. In most PC graphics controllers designed today, the graphics processor 10 also performs most of the miscellaneous control functions. VRAM refresh, horizontal and vertical sync information sent to the monitors, video blank signals for the RAMDACs and selection of the proper clock frequencies in the various graphics modes and resolutions, are all part of the graphics processor chip's function. Usually these requests result in text, symbols, lines and shapes being written into the VRAM frame buffer display memory 14. Memory data, address, and control information are provided by the graphics processor chip 10 to effect the writing and reading of information to and from this display memory 14. While there are typically at least 8 bits of memory per pixel which will be displayed on the monitor, 16-bit and 24-bit per pixel systems are also common. On systems capable of performing at 1280×1024 resolution, two megabytes of memory are commonly provided, since one megabyte is not adequate to cover the 1,310,720 pixels needed to produce this resolution.

Video RAM (VRAM) memory, instead of Dynamic RAM (DRAM), is used in advanced high end graphics systems, because of its two separate I/O ports. The VRAM port on the left side of VRAM 14 (denoted by the bus lines emanating from the HIGH RES. DATA, ADDRESS and CONTROL parts of the processor 10) is a random read/write port used by the graphics processor 10 to change the information shown on the display 20. The sequential I/O port on the right side of the VRAM block 14 is used to supply the serial video data to the RAMDAC 16. This port takes advantage of the serial nature of video information and provides a stream of data without adversely affecting the available bandwidth of the random I/O port. Although VRAM memory is more expensive than the DRAM used in lower performance systems, the net effect is that performance is typically more than doubled.

The Video RAMDAC blocks 16 and 18 provide two functions. First, a look-up table RAM memory (not shown) typically maps an 8-bit pixel value stored from the frame buffers VRAM into a set of three 8-bit values representing the red, green, and blue components of the desired color. Second, three digital to analog converters (not shown) produce the analog video levels used by the color monitor. In this way, an 8-bit per pixel value can be used to select one of 256 colors from a palette of over 16 million possible colors.

In FIG. 1 two RAMDACs 16 and 18 are shown. The RAMDAC 16 is shown receiving video data directly from the sequential port of the VRAM 14. This 32 bit path can provide four, 8-bit pixels to the RAMDAC 16 timed by the VIDEO RAM SHIFT CLOCK signal, thus reducing the video data shift frequency in higher resolution applications.

The RAMDAC 18 has only a single 8-bit data path input from a special VGA port on the graphics processor 10. In VGA mode and character mode, all video is further processed or mapped in order to be strictly compatible. Simply feeding VGA or character mode video from the sequential port of the VRAM 14 will not provide compatibility. FIG. 1 shows the two RAMDACs 16 and 18 having their analog outputs switched depending upon the video operating mode. However, in many conventional designs, these two functions are combined into a single RAMDAC chip. In either case, there will be two separate video data output ports, one typically 32 bits wide for high bandwidth VRAM video and used in the Microsoft Windows environment, and the other an 8-bit port which is provided for VGA and character mode video compatibility reasons.

Figure 2:
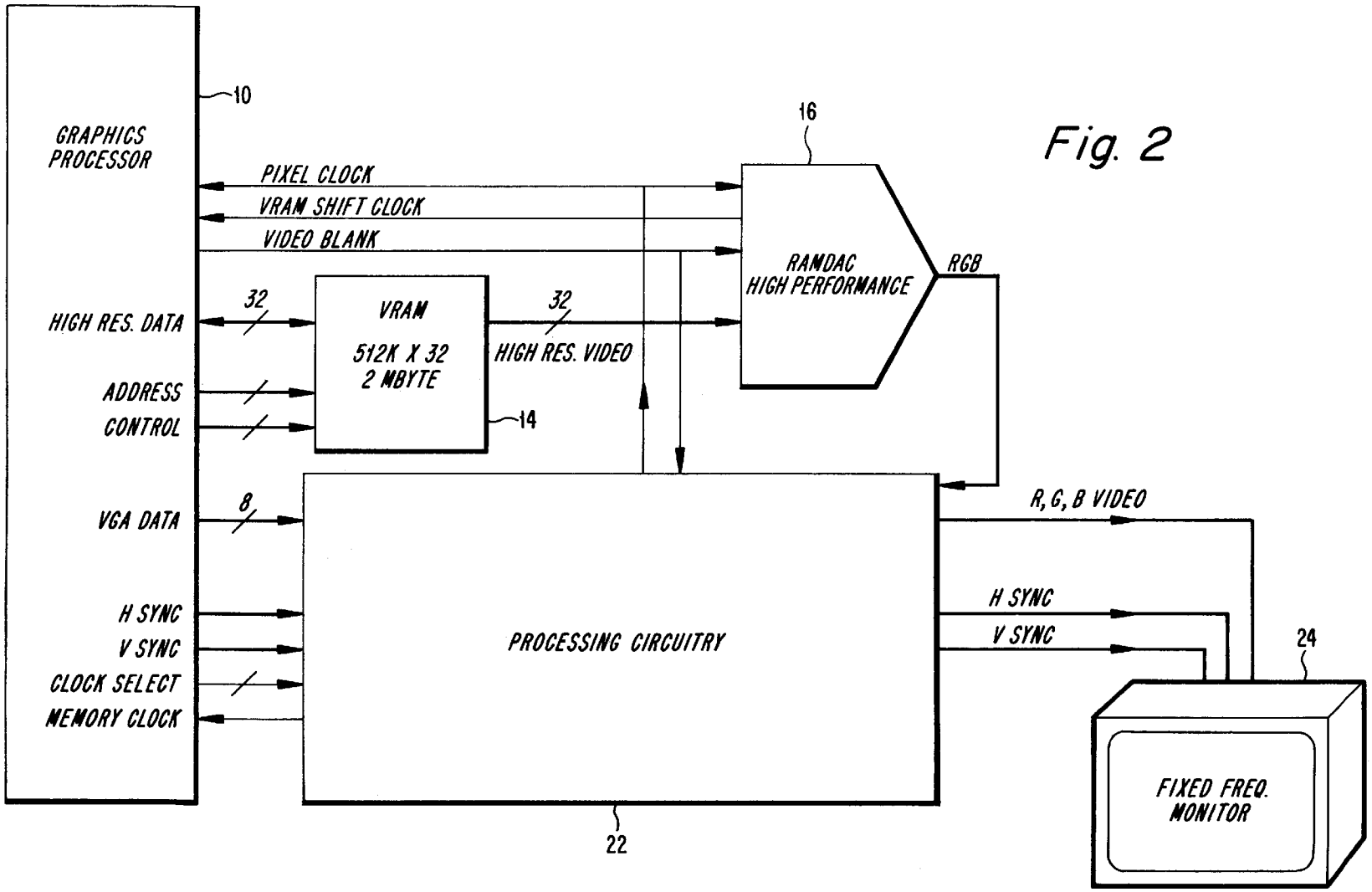
FIG. 2 is a general block diagram of a graphics controller/display combination according to an exemplary embodiment of the present invention.

A graphics controller and display according to an exemplary embodiment of the present invention is illustrated in FIG. 2. The same reference numerals are used in FIG. 2 to denote blocks having the same function as described with respect to FIG. 1. Note that a fixed frequency monitor 24 can be used in the graphics system of FIG. 2 instead of the multi-frequency monitor used in FIG. 1. The processing circuit 22 receives VGA and character mode video data from the graphics controller 10 by way of the traditional 8-bit video path. However, instead of this data being sent directly to a VGA style RAMDAC, exemplary embodiments of the present invention process the 8-bit low resolution video data and regenerate video information capable of driving a high resolution fixed scan frequency monitor 24. Thus, the present invention allows fixed scan rate monitors to be used by, for example, IBM compatible PCs.

For example, during boot sequences and during DOS graphics mode such as used by many legacy DOS applications, the processing circuit 22 detects the need for resolution conversion. This can be done, for example, by sensing the CLOCK SELECT line to select from the various pixel clocks for the different video resolutions. During normal high resolution mode, also sensed by the CLOCK SELECT lines, the processing circuit 22 can be deactivated and the high resolution RAMDAC 16 can be selected. The foregoing being a very general overview of an exemplary display system according to the present invention, detailed examples of the processing circuit 22 will now be described.

For purposes of illustration, the following exemplary embodiments describe implementations wherein the output device is a fixed frequency monitor having a resolution of 1184×884 and operating at a frame refresh rate of 60 Hz. This monitor is typical of monitors found in the workstation market, however, those skilled in the art will readily appreciate that the present invention is equally applicable to other output devices.

The character generator used by the original IBM PC produced raster data at character mode (720×400) resolution. Note that the pixels in character mode are not square, but are about 35% taller than their width when configured to provide an array of 80 characters on 25 lines. The VGA graphics mode (648×480) standard is in keeping with the desire for square pixels while in graphics mode, and matching the 3:4 aspect ratio of the physical CRT.

One object of the present invention is to regenerate a high resolution video signal from low resolution source data. Horizontally this can be accomplished by changing the video pixel clock timing to spread either, for example, the 640 or 720 (depending on the video mode) pixel scan line over the entire viewable scan line of the CRT. Assuming, for example, a horizontal sweep rate of 55.2 KHz, the horizontal scan period is approximately 18.1 microseconds, the pixel clock for the 720 horizontal pixels of character mode will use 14.3 microseconds/720 pixels or 19.8 nanoseconds/pixel for a frequency of 50.35 MHz. Likewise the 640 pixels of VGA mode will use 14.3 microseconds/640 pixels or 22.34 nanoseconds for a frequency of 44.75 MHz. These pixel clock frequencies are approximately twice the pixel clock frequencies needed to support character mode and VGA mode with slower frequency multiscan rate monitors, but are still well within the limits of current 8-bit RAMDACs.

The next step is to map the lower resolution data lines onto the higher resolution monitor. In the case of character mode there will be 884/400 or 2.21 high resolution scan lines/low resolution data line if, for example, a 884 line monitor is used. Similarly, VGA mode would require 884/480 or 1.8416666 high resolution scan lines/low resolution data lines.

There are three exemplary methods which will now be discussed for transforming low resolution data lines into higher resolution scan lines. These are: (1) nearest neighbor data line replication; (2) color blending of overlapping data lines on the same scan line; and (3) gamma correction of color blended overlapping data pixels. All of these exemplary methods can be used to transform low resolution data lines into higher resolution scan lines in exemplary embodiments of the present invention.

To illustrate the nearest neighbor method, consider two horizontal lines, each only one VGA data pixel high and spanning the width of the screen. Since, for the 884 line monitor used in this example, there will be on average 1.8416666 high resolution scan lines per VGA data line, roughly five out of six VGA data lines will be represented by two high resolution scan lines, and about every sixth horizontal data line will be rendered with a height of one high resolution scan line. This will make the weight of this horizontal data line be only half that of the other five. This effect is illustrated graphically in FIG. 3(*a*) by the thinner line segments. In general these effects are not objectionable since most legacy character mode and VGA graphics mode applications have never been known for their high fidelity.

Figure 3A:
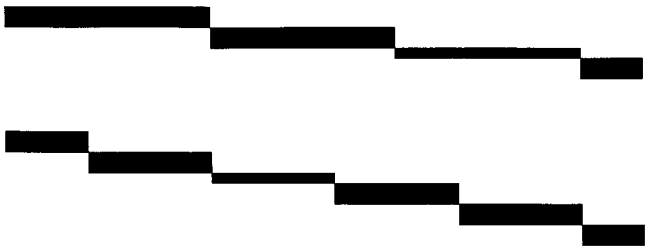
FIG. 3(*a*)–3(*c*) graphically illustrate exemplary methods for transforming low resolution data lines into high resolution scan lines.
Figure 3B:
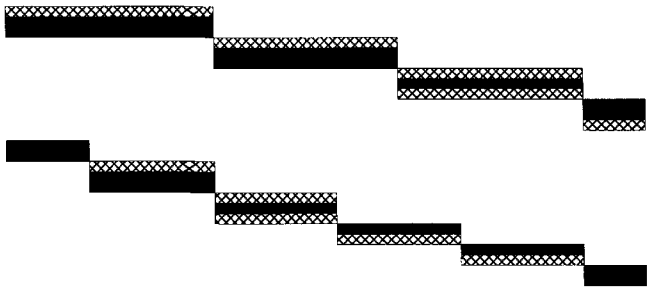
Figure 3C:
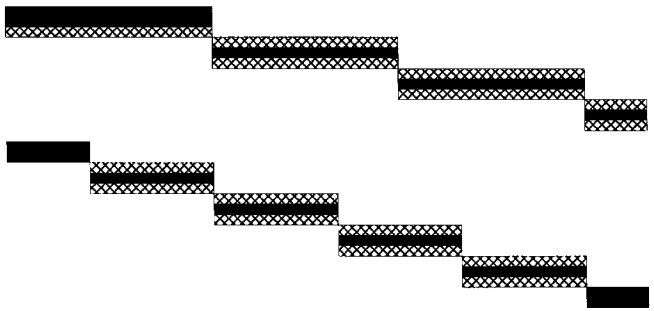

Color blending of overlapping data pixels on the sample high resolution scan line is a good method for correcting pixel height distortion. For those high resolution scan lines which have two overlapping data lines contributing to its pixel values, the red, green, and blue color values are determined for each of the pixels on the two data lines, and then combined as a weighted average based on the area covered by each of the data pixels. In general, this method better represents the weight of pixels and provides a truer representation than the nearest neighbor method. FIG. 3(*b*) illustrates lines created using the color blending method.

According to another exemplary embodiment, gamma correction can be applied to the output of the blended scan line video. Both the human eye and the properties of a color CRT are nonlinear in their perception or replication of light intensity. A gamma correction circuit can be used to correct for this nonlinearity and provides compensation for errors in color hue and intensity when data pixel red, green, and blue values are being blended. FIG. 3(*c*) graphically illustrates the effect of gamma correction to the color blended lines of FIG. 3(*b*).

The following description illustrates exemplary implementations of the above-described methods, i.e., scan line re-sampling using the nearest neighbor, color blending and color blending with gamma correction methods. Each of these methods will first be presented as a short BASIC program segment for illustration and then by a block level circuit diagram, of course those skilled in the art will readily appreciate that any appropriate programming language can be used to implement these methods. The following methods deal only with the vertical interpolation of the scan line pixels. As described earlier, the horizontal re-scaling of data line pixels can be accomplished by adjusting the pixel timing of outbound pixel information sent to the RAMDAC 16 since the monitor 24 has no intrinsic concept of pixels' horizontal size but simply responds to the analog video information sent by the RAMDAC 16.

The underlying concept of the nearest neighbor method is relatively simple—if a scan line is covered by more than 50% of a particular VGA data line, the scan line pixel values will be set to those VGA data line pixel values. The following exemplary program illustrates how the nearest neighbor method can be implemented.

Definitions

A=Dmax/Smax;

where: Dmax is the number of high resolution destination scan lines to be displayed, e.g., 884 in the above example, and Smax is the number of low resolution source data lines to be processed. This would be, for example, 480 for a VGA size image. In the above example A=884/480=1.8416666.

Spix(p,q) is the array of VGA source data pixels before they have been mapped through the VGA look-up table.

Dpix(i,j) is the array of high resolution destination scan line pixels to be selected from Spix(i,j).

```
Program
    ACCUM=A
    K=1
    FOR J=1,Dmax
        IF (ACCUM>=1.0) THEN
            LINE=K
            ACCUM=ACCUM−1.0
        ELSE
            IF (ACCUM>=.5)
            LINE=K
            ELSE
                LINE=K+1
            END IF
            ACCUM=ACCUM−1.0+A
            K=K+1
        END IF
        FOR I=1,640
            Dpix(I,J)=Spix(I,LINE)
        NEXT I
    NEXT J
```

Since the color blending technique is based on area coverage of the red, green, and blue source data pixel color values, the blending of the pixels in the data lines is performed after the color index values have been converted by the look-up table (not shown) found in the RAMDAC 16. Once the red, green, and blue components of the data line pixels are known, the two source data lines overlapping the same high resolution destination scan line can be blended using a weighted average based on the area of coverage of the two source data lines covering the scan line being output to the monitor. The area of coverage of a destination scan line by a source data line can be computed, for example, by the following program statements.

Definitions

A=Dmax/Smax;

where: Dmax is the number of high resolution destination scan lines to be displayed, e.g., 884 in the above example. In the above example A=884/480=1.8416666.

Smax is the number of low resolution source data lines to be processed. This would be, for example, 480 for a VGA size image.

Spix(p,q) is the array of VGA source data pixels after they have been mapped through the RAMDAC look-up table. The Spix value is divided into red, green, and blue 8-bit values. For the sake of illustrative simplicity this program is written to illustrate the processing of only a single color component.

Dpix(i,j) is the array of high resolution destination pixels to be computed. Dpix is also composed of red, green and blue 8-bit values. Again, for simplicity, only a single color component is illustrated.

```
Program
    ACCUM=A
    K=1
    FOR J=1,Dmax
    IF (ACCUM>=1.0) THEN
    W1=1.0
    ACCUM=ACCUM − 1.0
    ELSE
```

-continued

```
        W1=ACCUM
        ACCUM=ACCUM − 1.0 + A
        END IF
        W2 =1.0 − W1
        FOR I=1,640
            Dpix(I,J)=Spix(I,K)*W1 + Spix(I,K+1)* W2
        NEXT I
    NEXT J
```

The foregoing exemplary program generates an array of pixels Dpix(I,J) consisting of Dmax scan lines with 640 pixels per scan line. The resulting array represents the transformation of a 640×480 source data pixel array into a 640×884 destination array. The output scan lines are vertically re-sampled and antialiased. For destination scan lines completely covered by a source scan line, the value of the source data line pixel values is simply selected.

Destination scan lines which are partially covered by two source scan lines are computed by performing an area of coverage blend. This is represented by the statement:

$$Dpix(I,J)=Spix(I,K)*W1+Spix(I,K+1)*W2$$

where the I pixel in the J scan of the high resolution display is computed by the weighted average of the K and K+1 source data lines, and where W1 and W2 are the weighing multipliers to be applied. Note that the sum W1+W2 is equal to 1.0.

The third exemplary method provides gamma correction to the color blending method. Digital to analog converters used in video applications are linear, however the human eye perceives light intensities on a logarithmic basis and the CRT electron gun is also non-linear in its response to cathode voltages. The additional non-linear transformation provided by gamma correction adds an additional level of fidelity to the scan line re-sample algorithm discussed above. This gamma correction can be applied after the scan line blend. Gpix,(I,J) represents the corrected value for the red color component. Similar green and blue correction can also be provided, but only gamma correction for red is discussed here for simplicity. Yr is the gamma factor for the red correction which can be determined using known, textbook equations. Thus a statement representing gamma correction for red is:

$$Gpix_r(I,J)=(Dpix_r(I,J))^{1/Yr}$$

Having now described the general concepts behind exemplary embodiments of the present invention, detailed exemplary implementations of processing circuit 22 will now be discussed. Those skilled in the art will readily appreciate that these exemplary implementations are by no means the only techniques available to implement the present invention.

During the re-sampling and display of the exemplary VGA image onto the 884 scan line monitor, the exemplary embodiments progress through a number of phases. Rather than show an overly complex logic diagram, the inputs and outputs of the exemplary circuits are shown, and the scan conversion from VGA data lines into actual high resolutions scan lines, on a phase by phase basis is defined. From these definitions, a state machine can easily be implemented in a programmable gate array by those skilled in the art.

The following line descriptions apply to each of the three exemplary embodiments illustrated in FIGS. 4–9. The VGA DATA IN line carries an 8-bit parallel video data signal generated by the graphics processor 10 and, in conventional systems, ordinarily sent directly to the VGA RAMDAC 18.

In the present invention, this data will be used to regenerate a full screen VGA image on a higher resolution monitor.

The BLANK IN line carries a signal generated by the graphics processor 10 which, in conventional systems, is ordinarily sent to the VGA RAMDAC 18 to insure the blanking of non-visible pixels during the horizontal and vertical retrace intervals. In these exemplary embodiments of the present invention, BLANK IN is used to signal the beginning and end of visible VGA DATA IN pixels being loaded into the FIFO 40.

The PIXEL CLK IN line ordinarily carries a free running pixel clock signal used to feed data from the graphics processor 10 to the VGA RAMDAC 18. However, in these exemplary embodiments PIXEL CLK IN is used to clock data into the FIFO 40. This clock is not free running in the exemplary embodiments of the present invention, but rather is carefully stopped and started by flow control logic in the control block 42 to feed visible data into the FIFO 40.

The H SYNC IN line carries the horizontal sync signal which is usually sent to the monitor in conventional systems so that the multisync monitor can adjust the horizontal sweep rate and adjust the phase relationship of the scan to the visible VGA data. This signal has limited usefulness in the present invention since H SYNC OUT is generated independently, however it can be used, for example, when using the present invention in conjunction with conventional multisync monitor configurations. When used with a conventional multisync monitor, methods and systems according to the present invention provide improved visual quality of images in, for example, VGA and character mode while operating the multisync monitor in a higher resolution mode.

The V SYNC IN line carries a vertical sync signal which is usually sent to the monitor in conventional systems so that the multisync monitor can adjust the vertical sweep rate and adjust the phase relationship of the vertical scan to the visible VGA data. In the present invention this signal can be used in conjunction with the fixed scan monitor timing to generate a top of frame reset.

The CLOCK/RESOLUTION SELECT line allows PC graphics controllers according to the present invention to run at a variety of different resolutions and refresh rates. There are a variety of clock generators which generate the necessary different clock frequencies used to support the various resolutions and modes of display. For example, three additional frequencies can be generated. A first frequency can be generated for the native high resolution of the monitor 24 being used, which may be different than the defacto standards currently used in the PC industry. A second frequency corresponding to the 640 pixels per scan line used in VGA, EGA and CGA modes and a third frequency corresponding to the 720 pixels per scan line used in character mode can be generated.

The MONITOR RESOLUTION SELECT line provides signals which are used to select one of several supported fixed scan rate monitors. The MEMORY CLK line provides the master timing clock signal for the graphics processing subsystems of the graphics processor 10. Typically, this clock operates at a fixed frequency independent of the video rate and scan frequency of the monitor 24. This signal determines the writing speed of information into the frame buffer memory 14.

The R, G, B signal line carries the analog red, green, and blue video signals sent to the monitor 24. The H SYNC OUT signal line carries the horizontal sync signal sent to the monitor 24. The V SYNC OUT signal line carries the vertical sync signal sent to the monitor. The PIXEL CLOCK signal line is the conventional pixel clock sent to the high performance RAMDAC 16 during normal operation.

Next, an exemplary embodiment of the present invention wherein the processing circuit 22 uses the nearest neighbor method for transforming data will be described with reference to FIG. 4. The first-in first-out (FIFO) memory block 40 is typical of single chip FIFOs which are commercially available, for example, the AMD Am7202A. This 1K×8 FIFO 40 is available in a variety of pin compatible performance levels. Significant features of FIFO 40 include the ability to RESET, RETRANSMIT or RE-SEND information and indicate when the FIFO 40 is empty. The depth of the FIFO 40 can be, for example, adequate to hold a complete data line of either 640 pixels (VGA) or 720 pixels (character mode).

The VGA RAMDAC 44 can be chosen from off-the-shelf components, such as the Brooktree Bt475 and Bt477. A variety of speed performance levels are available, including speeds in excess of 100 MHz as well as a variety of configurations. For example, RAMDACs such as the Brooktree Bt475 combine both the high performance 32-bit port with the 8-bit VGA port into a single device, thereby reducing printed circuit board real estate, cost and analog circuit switching and loading. All of the logic functions for circuitry according to the exemplary embodiment can be reduced into a single Field Programmable Gate Array (FPGA) indicated generally by reference numeral 46. The control block 42, timing block 48, and clock select logic block 50, although used to provide separate functions, can fit into a single chip.

The control block 42 provides, for example, the following functions.

- Generating the PIXEL CLK IN signal which provides flow control of VGA DATA IN to the FIFO 40.
- Generating FIFO WRT ENABLE which is used to gate visible VGA DATA IN pixels into the FIFO 40. Visible pixels are determined using of the BLANK IN signal.
- Providing the decision function which controls the RESET and RE-SEND signals. This function is initialized during the vertical retrace & blank phase by the FRAME RESET signal.

Figure 5:
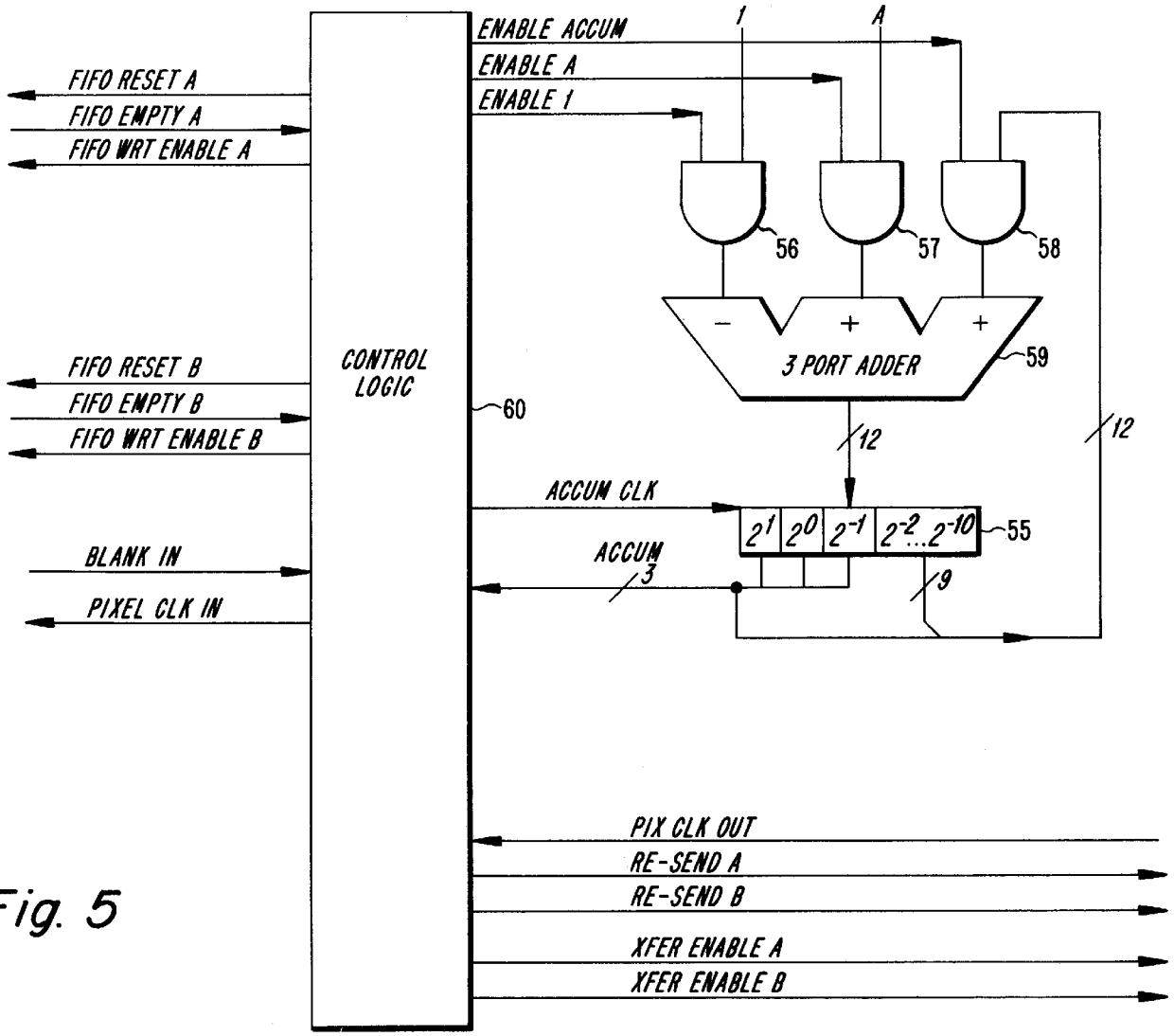
FIG. 5 is a block diagram which shows an exemplary embodiment of the control block of FIG. 4.

The vertical retrace & blank phase is illustrated in FIG. 5 and discussed in more detail below.

- Generating XFER ENABLE which is used to enable the transfer of PVIDEO DATA OUT from the FIFO 40 to the VGA RAMDAC 44. This process begins with the BEGIN SCAN signal and terminates when FIFO EMPTY is returned.

The timing block 48 provides the function of generating the FRAME RESET and BEGIN SCAN signals for the control block 42 and the H SYNC OUT and V SYNC OUT signals for the fixed scan rate monitor 24. This can be accomplished with, for example, simple divide-by counting chains from the PIX CLK OUT signal.

The clock select logic block 50 evaluates the CLOCK SELECT signals coming from the graphics processor 10 and the MONITOR SELECT signals supplied by configuration jumpers (not shown), so that more than one fixed scan rate monitor can be supported by the same graphics board. The clock select logic block 50 outputs a FREQ SEL signal to clock generator 54. The clock generator 54 generates a selected one of a plurality of frequencies which correspond to the number of pixels per scan line. Although the exemplary embodiment illustrates only one clock generator, a plurality of clock generators can be provided and selection of output frequencies can be achieved by, for example, one or more multiplexors.

An exemplary implementation of the control block 42 is illustrated in FIG. 5. This configuration can be used, among other functions, to perform the BASIC program segment described above. For example, the contents of the accumulator 55 can be set equal to A, added to −1, or added to A-1. Each of the inputs to AND gates 56, 57 and 58 can selectively be output to the three port adder 59 when the control logic 60 provides a logic one on the enable 1, enable A and enable ACCUM signal lines, respectively. The three port adder 59 then transfers this new value to the accumulator 55, clocked in by the ACCUM CLK signal.

The three most significant bits of the accumulator 55 are input to the control logic 60, two of which bits represent the whole number portion of the value in the accumulator and the third of which is the most significant of 10 fractional bits. These three bits are evaluated to determine which low resolution data line to use for this iteration as described in the exemplary BASIC program. Thus, these three bits can be used by the control logic 60 to decide whether to re-send or advance to the next data line. Although the exemplary implementation of FIG. 5 uses 12 bits, those skilled in the art will readily appreciate that more or fewer bits can be used depending, for example, on the value of A, the level of round off error which is tolerable, and the number of lines on the high resolution monitor.

Figure 4:
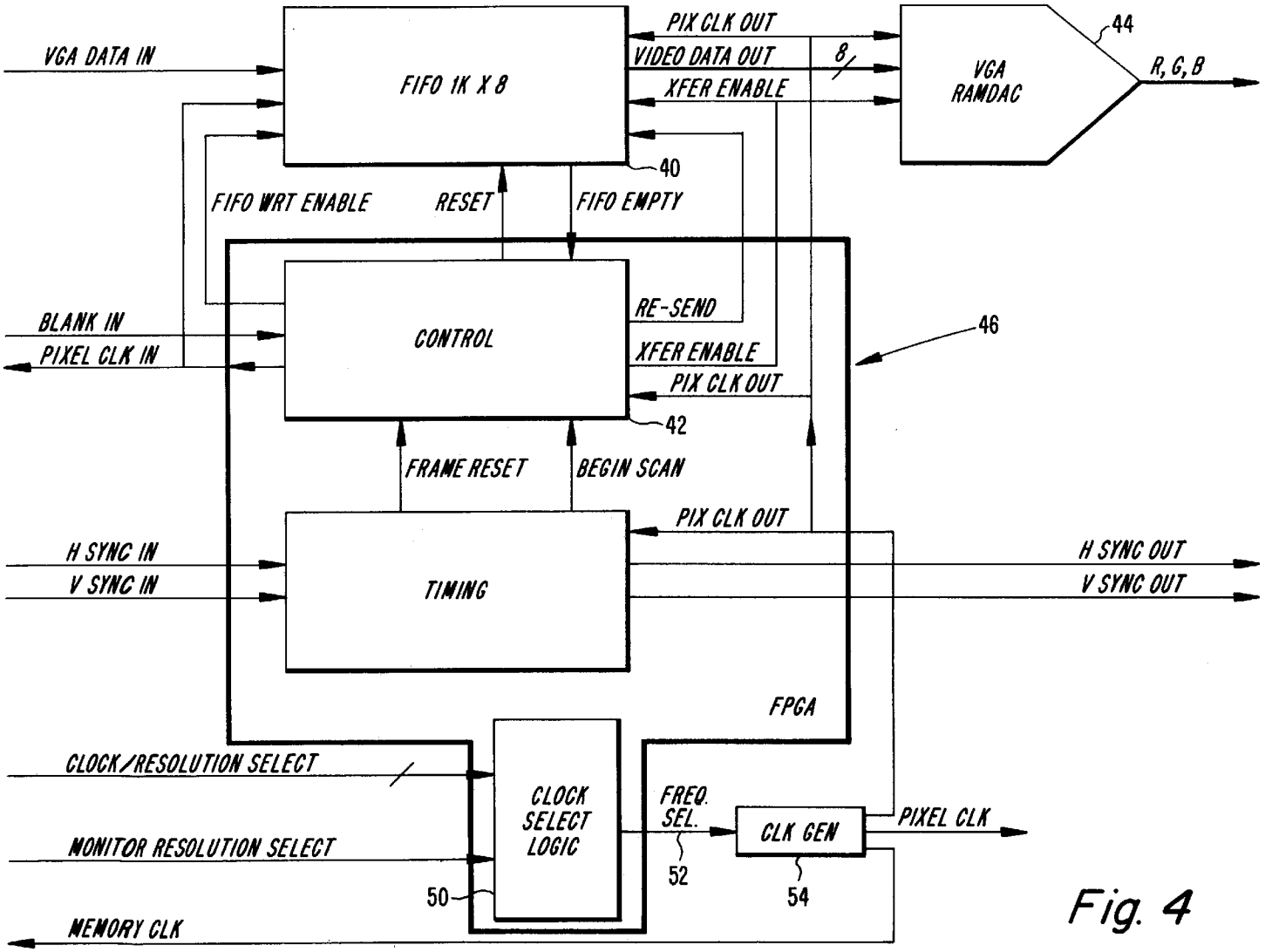
FIG. 4 is a block diagram illustrating a first exemplary embodiment of the processing circuit 22 in FIG. 2.
Figure 6:
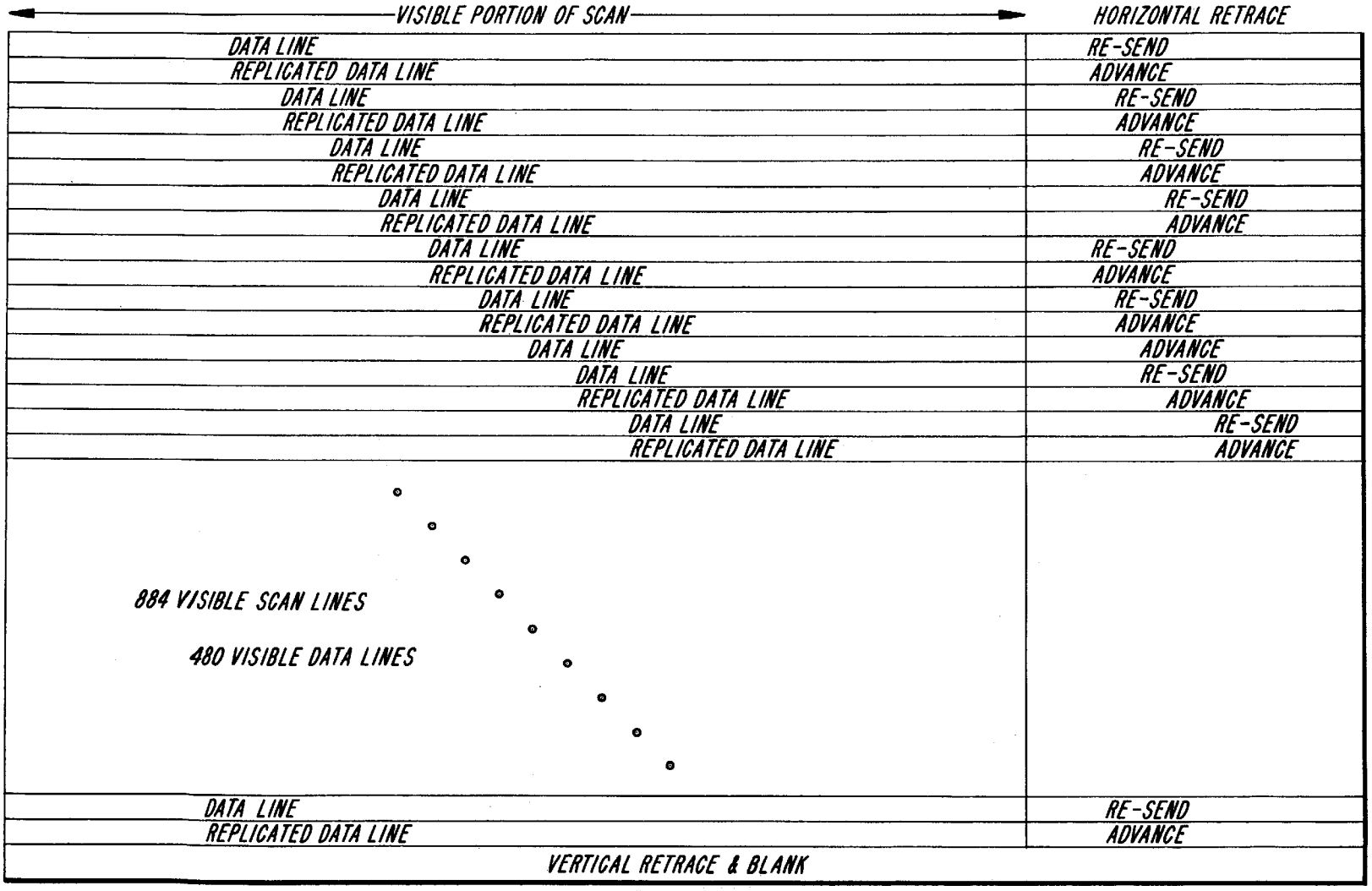
FIG. 6 is a phase diagram which illustrates the operation of the exemplary embodiment of FIG. 4.

Having described the elements comprising the exemplary processing circuit of FIGS. 4 and 5, FIG. 6 is used to illustrate the various phases through which this circuit transitions during operation.

The vertical retrace and blank phase is an initialization phase which begins with the end of the last visible scan line and the assertion of the V SYNC OUT signal. This phase lasts, for example, approximately 652 microseconds as timed by 36 invisible scan lines under control of counters (not shown) located in the timing block 48. During this phase, FRAME RESET is sent to the control block 42 where the accumulator is initialized. Next the FIFO 40 is RESET, PIXEL CLK IN is turned on, and the first visible data line pixels are loaded into the FIFO 40. The first visible data line begins as BLANK IN is de-asserted and ends when BLANK IN is reasserted. Load control of FIFO 40 is performed by the control block 42 which issues the FIFO WRT ENABLE signal. This phase ends and the data line PHASE begins after the assertion of BEGIN SCAN from the timing block 48.

The data line phase begins with the BEGIN SCAN signal being asserted from the timing block 48 after the vertical retrace and blank phase or after the advance phase. XFER ENABLE is then sent to the FIFO 40 and RAMDAC 44 from the control block 42. This begins the unloading of VIDEO DATA OUT from the FIFO 40 to the RAMDAC 44. The VGA RAMDAC blank control is de-asserted during this time via the XFER ENABLE line.

During this phase, the control block 42 calculates the next value for the accumulator which is contained in the control block 42 and whose function is described in the above-described exemplary BASIC program. The data line phase ends when the FIFO 40 signals FIFO EMPTY to the control block 42.

The re-send phase occurs if the control block 42 should decide to copy the last data line to represent the next scan line. In this phase no new information is loaded from the graphics processor 10 into the FIFO 40. Instead, the data in the FIFO 40 used from the last scan line is reused. A feature of many modern RAM-based fifos is the ability to reset the read pointer (counter) to zero without affecting the write pointer (counter). The RE-SEND signal from the control block 42 is used for this purpose. In this way, the FIFO 40 is prepared to re-transmit the data at the BEGIN SCAN signal sent from the timing block 48 to the control block 42. The re-send phase is followed by the replicated data line phase which starts with the BEGIN SCAN signal.

The replicated data line phase re-sends the data line information still held in the FIFO 40 from the last scan line. During this phase the control block 42 calculates the next value for the accumulator (not shown) in the control block 42 and whose function is described in the above-listed BASIC program. Based on the current value of the accumulator, the advance phase is selected or the re-send phase is selected again. The replicated data line phase ends when FIFO EMPTY is asserted.

The advance phase signals that a new data line is needed in the FIFO 40. The control block 42 will RESET the FIFO 40 and begin loading the next data line of visible pixels from the graphics processor 10 into the FIFO 40. Generally only the first part of the data line will be loaded into the FIFO 40 at the time the BEGIN SCAN signal starts the transmission of VIDEO DATA OUT. This is of no concern so long as the PIXEL CLK IN frequency is high enough so as not to allow the FIFO 40 to become empty prematurely. This phase ends with the BEGIN SCAN signal for the next scan line. However, VGA DATA IN still continues to be loaded into the FIFO until BLANK IN is asserted. The data line phase follows the advance phase when using the nearest neighbor algorithm.

The above phases are illustrated in FIG. 6 as they relate to an exemplary CRT beam position on the face of the fixed frequency monitor. The dark shaded areas represent times when the blank signal is asserted to the VGA RAMDAC 44.

The sequencing of the phases DATA LINE, RE-SEND, REPLICATED DATA LINE, ADVANCE, DATA LINE, RESEND, etc. is illustrative of a pattern which could result when using the above-described nearest neighbor algorithm.

Figure 7:
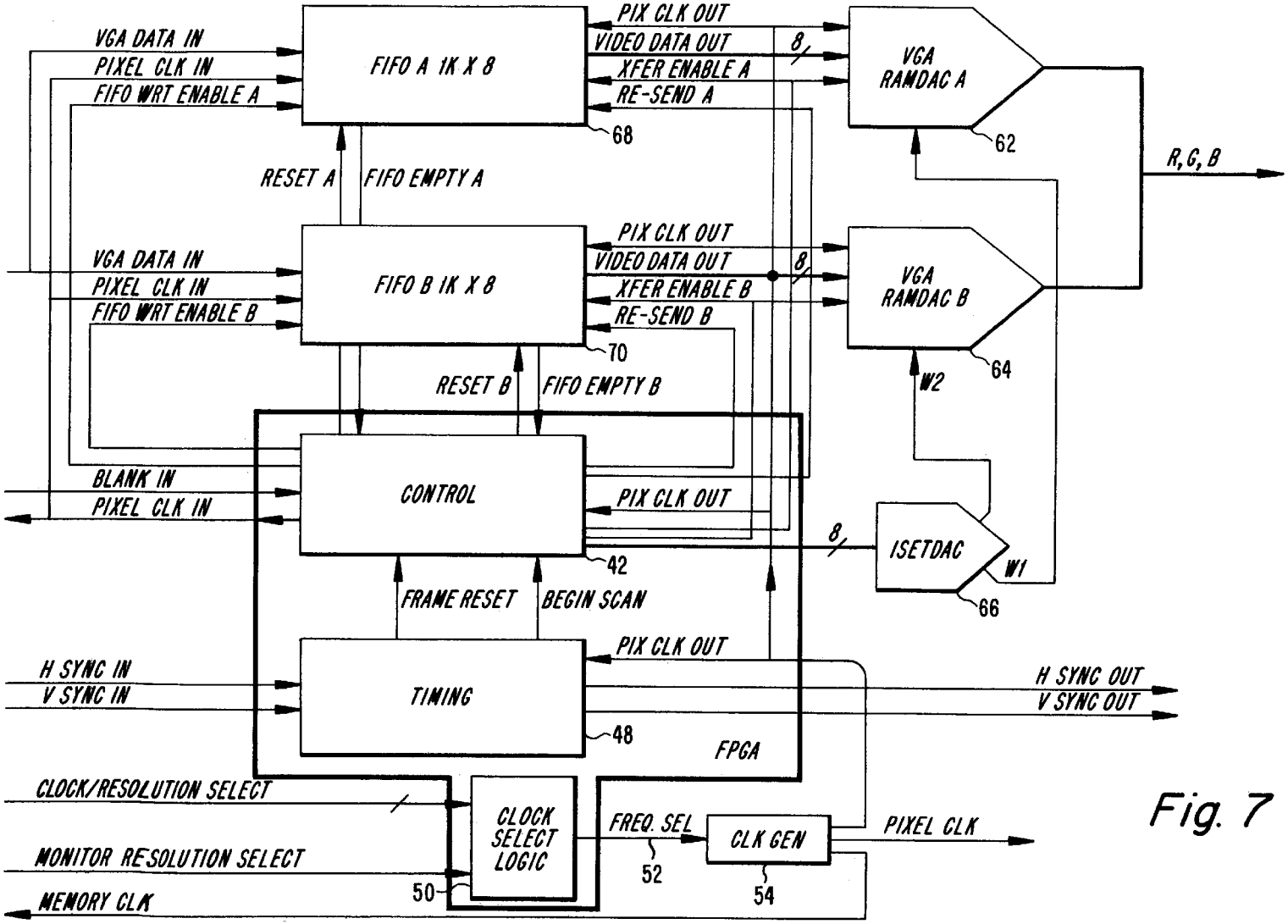
FIG. 7 is a block diagram illustrating a second exemplary embodiment of the processing circuit 22 of FIG. 2.

Having described the operation of an exemplary embodiment of the present invention which uses the nearest neighbor method, another exemplary embodiment will now be described with reference to FIG. 7 wherein the color blending method is used to translate the video signals. In FIG. 7, similar reference numerals and signal line names are used to denote functional blocks and signal lines, respectively, which operate in the same manner as described above with respect to the exemplary embodiment of FIG. 4.

However, differences between the nearest neighbor method and color blending method translate into structural differences between these exemplary embodiments. Note, for example the following lines at the end of the BASIC program which is used to illustrate the color blending method.

```
FOR I=1,640
   Dpix(I,J)=Spix(I,K) * W1+Spix(I,K+1) * W2
NEXT I
```

Instead of choosing the nearest source data line Spix(I,K), a weighted average between the pixels of the K and K+1 data lines is chosen. In the exemplary embodiment of FIG. 7, weighting factors W1 and W2 are implemented as analog currents sourced from the ISETDAC 60. The W1 and W2 currents sum to the currents needed to create the necessary full range video which is normally supplied to the single RAMDAC 18 of FIG. 2. In this way, the two RAMDACs 60 and 64 are essentially functioning as multiplying DACs. The output from the look-up table Spix(I,K) (not shown) in the ISETDAC 60 acts as a digital fraction between one and zero, and multiplies the ISET current W1 to produce the weighted average component which is added to Spix(I,K+1)*W2.

Instead of one FIFO as in the previous embodiment, two FIFOs 68 and 70 are used. This double buffered arrangement allows both the K and K+1 data lines to be present in FIFO 68 and FIFO 70, respectively. Thus, both data lines can be shifted into RAMDAC 62 and RAMDAC 64, multiplied by W1 and W2 using the multiplying DAC feature of the RAMDACs, and the current outputs of the RAMDACs summed together to drive the R, G, B video of the monitor 24.

Figure 8:
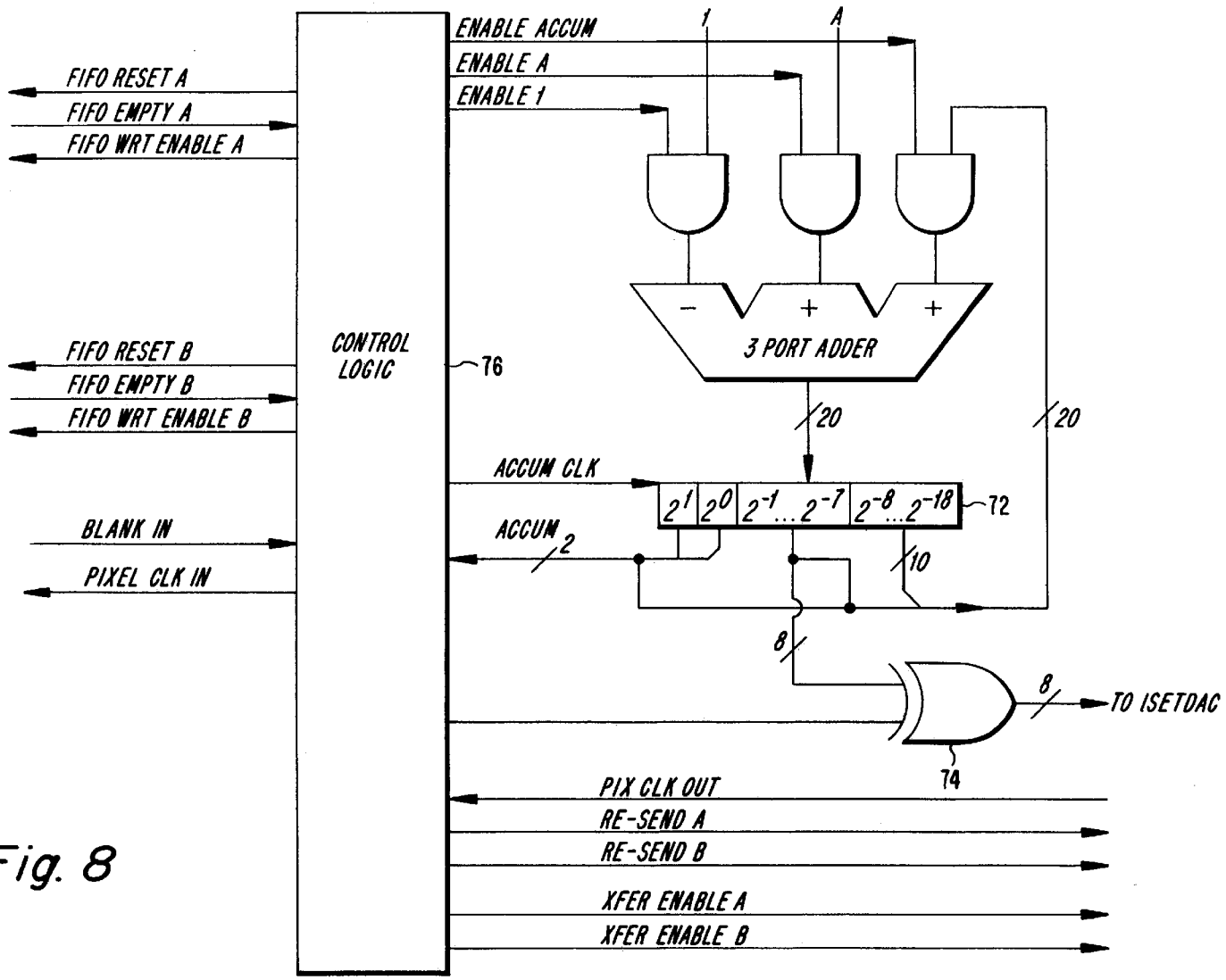
FIG. 8 is a block diagram which shows an exemplary implementation of the control block of FIG. 7.

As mentioned above with respect to FIG. 5, for the exemplary resolution of 884 lines, an adder and accumulator of, for example, 12 bits can be used to implement transformation methods according to the present invention. For the blending method, 20 bits can be used with 8 additional fraction bits being provided to supply accurate values for W1 and W2 without incurring rounding propagation errors caused by iterating the algorithm by the number of scan lines on the display. An exemplary implementation of control block 42 of FIG. 7 is shown in FIG. 8. In this example, the accumulator 72 uses 2 integer bits and 18 fractional bits. The most significant 8 fractional bits are used to set the value of the 8-bit ISETDAC 60.

The EXCLUSIVE-OR gates 74, under the direction of the control logic 76, provide a ones complement of the 8 most significant bits of the accumulator fraction. This feature compensates for the data lines being stored alternately in FIFO 68 and then FIFO 70. Although the FIFOs 68 and 70 share common PIXEL CLK IN, VGA DATA IN, and PIX CLK OUT signals, all other enable signals to FIFOs 68 and 70 and RAMDACs 62 and 64 are separate and independently controlled to effect the color blend method.

FIG. 9 illustrates the activities of FIFO A, FIFO B, and the weighting values W1 and W2 which are to be applied to the VGA RAMDACs 62 and 64. Also shown is the ACCUM value computed during the horizontal blank time for each scan line of an 884 visible scan line display presenting 480 visible data lines. The ACCUM value is used to compute whether FIFO A or FIFO B is to ADVANCE or RE-SEND and also determines the values W1 and W2 which are applied to VGA RAMDACs 62 and 64 shown in FIG. 7.

As discussed earlier, there is a variation on the color blend method which can improve image quality known as gamma correction. In general terms, the desire is to compensate for the CRT and human eye non-linearities. This will give color intensity interpolation which is more consistent with what the human viewer expects. This could be implemented with a gamma correction amplifier which can be placed in series with the summed output of the two RAMDACs 62 and 64 shown in FIG. 7. Alternately, a mathematical equivalent can be provided which is implemented as a digital sum of products rather than using the multiplying DAC features of the RAMDAC and ISETDAC circuits shown in FIG. 7. This exemplary embodiment is shown in FIG. 10, wherein reference numerals which have been reused refer to circuits or elements having earlier described functions.

Figure 10:
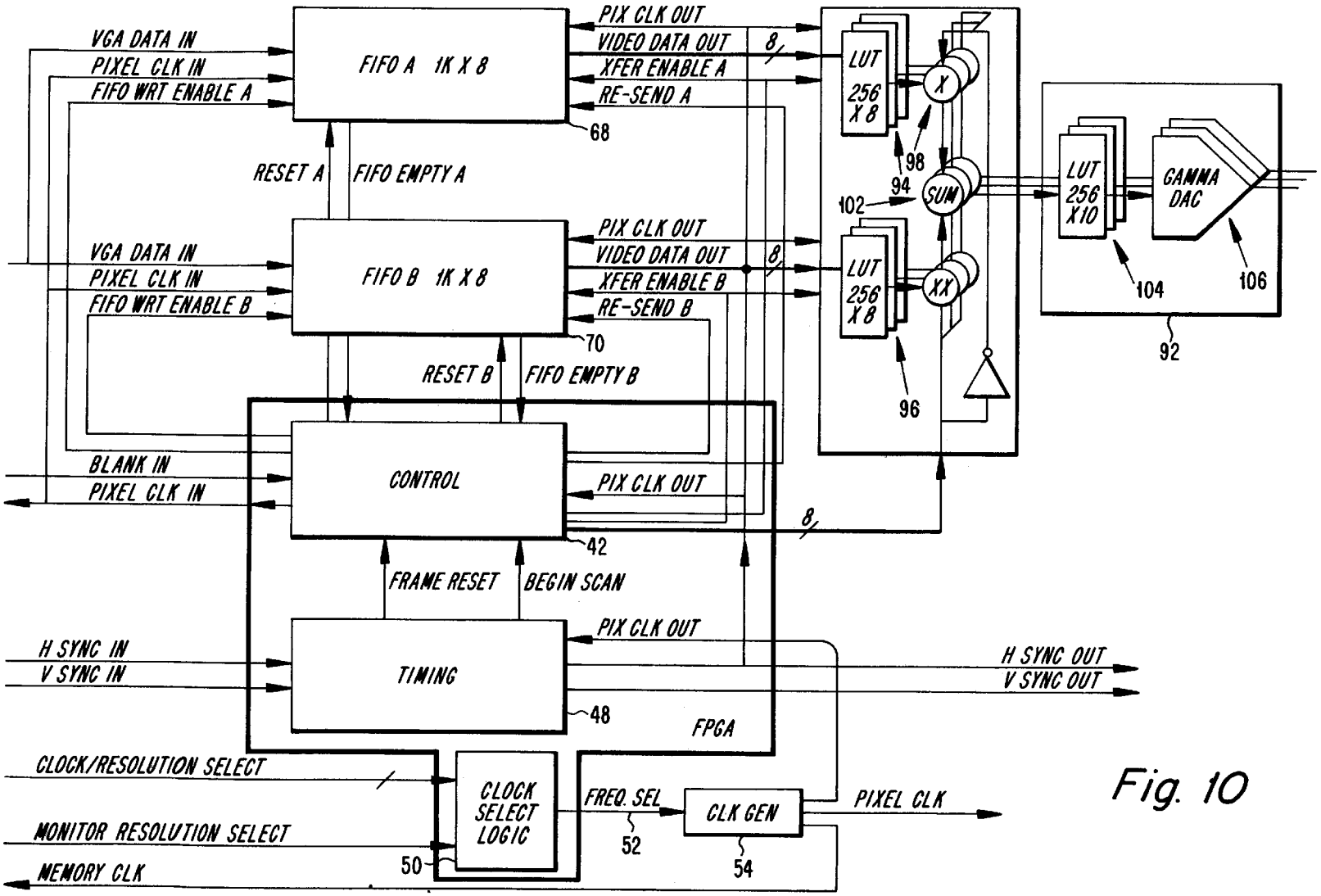
FIG. 10 is a block diagram illustrating a third exemplary embodiment of the processing circuit 22 of FIG. 2.

In FIG. 10, the VGA RAMDACs 62 and 64 and the ISETDACs 60 have been replaced by the digital blending circuit 90 and gamma DAC circuit 92. The digital blending circuit 90 includes two sets of RGB look-up tables 94 and 96 which map the 8-bit color index information into the 8-bit red, green, and blue values corresponding to the index value. Since color values are being blended, these two sets of look-up tables 94 and 96 are provided to support the two streams of color index data coming from FIFO 68 and FIFO 70. For example, six 256×8 bit RAMS can be used as look-up tables 94 and 96.

Six 8-bit multipliers generally denoted by reference numerals 98 and 100 and three 8-bit adders 102, (although larger adders can be used to minimize rounding errors) are provided to generate the digital sum of products for the red, green, and blue values. This step was described in the color blending program as:

$$Dpix(I,J)=Spix(I,K)*W1+Spix(I,K+1)*W2$$

The gamma DAC circuit receives three 8-bit red, green, and blue digitally blended color values and uses three additional look-up tables 104 each, for example, having a size of 256×10 bits which in turn drive three 10-bit DACs 106. The contents of the look-up tables 104 provide the gamma correction function. Of course any corrective function can be loaded into the look-up tables 104 to thereby overcome the effects of the non-linear behavior in the systems and the human eye. Moreover, those skilled in the art will appreciate that the DAC 106 need not be 10 bits wide and that, in fact, the number of bits used throughout these exemplary embodiments can be adjusted to provide better resolution, more color information, etc. For example, 16-, 32- and 64-bit video can be implemented according to the present invention using wider components, e.g., FIFOs and RAMDACs.

The exemplary embodiments shown thus far represent only a few of the ways in which the present invention can be implemented. Those skilled in the art will appreciate that many modifications of these exemplary embodiments are possible without deviating from the principles set forth therein. For example, the FIFO 40 and the FPGA 46 can be replaced with a single, low cost standard cell or gate array circuit.

The memories used for data line buffering need only be as large as the data line information. In character mode this would be 720 bytes and in VGA mode this would be 640 bytes. Thus additional circuitry savings are possible on custom chip implementations by reducing the exemplary 1K×8 static rams to only the memory depth needed for a particular application.

Figure 11:
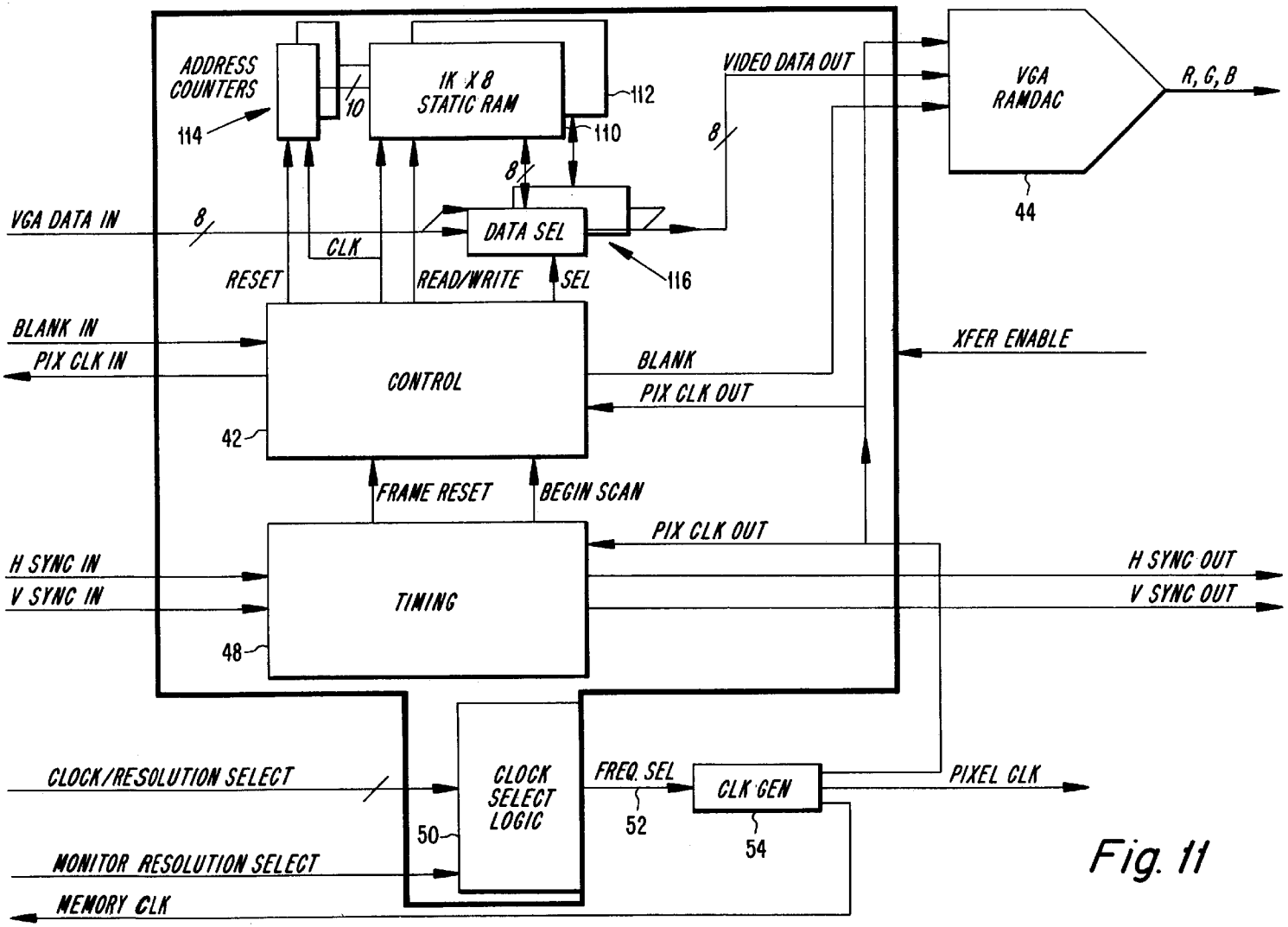
FIG. 11 is a block diagram illustrating a fourth exemplary embodiment of the processing circuit 22 of FIG. 2.

Instead of FIFOs, single ported memories configured in a double buffered arrangement can be used. An exemplary embodiment using the nearest neighbor algorithm is illustrated in FIG. 11, wherein two static RAMS 110 and 112 are used. This exemplary configuration allows one static RAM memory to supply scan line pixel to the RAMDAC while the alternate static RAM memory receives data line pixels from the graphics processor. Once the control block 42 sends the scan line data a predetermined number of times, the static ram memory buffers 110 and 112 reverse roles, allowing the new data line received from the graphics processor to be output to the RAMDAC 44. The retransmit function can be accomplished by simply resetting the counters 114 supplying the address to the memory data being transmitted to the RAMDAC 44. Advancing to the next data line can be done by resetting the counters 114 and swapping the transmit and receive roles of the memories 110 and 112.

The static RAMS 110 and 112 in the exemplary embodiments can be synchronous which allows the data to either be loaded from or stored to a bi-direction I/O register internal to the RAM. This allows the transfer of data and the incrementing of the address counter to be synchronized and driven from the same clock. Data steering is provided by the SEL signal from the control block 42 and the data select blocks 116. This concept can be further generalized for both of the blend algorithms by using three static RAM memories and counters so that the last two data lines can be read from two of the static memories while the third memory and counter are used to load the next data line from the graphics processor.

While the present invention has been described in terms of the foregoing exemplary embodiments, those embodiments are considered in all respects to be for purposes of illustration, rather than restriction, of the present invention. The scope of the present invention is set forth in the appended claims and any and all modifications and equivalents of those claims are intended to be encompassed thereby.

What is claimed is:

1. A signal processing system comprising:

means for receiving a low resolution source data line;

means for storing said low resolution source data line;

means for adjusting a horizontal pixel spacing of said low resolution source data line;

means for mapping said low resolution source data line onto one or more nearest neighboring higher resolution destination data lines which have at least a majority area covered by said low resolution source data line;

said mapping means including:

means for storing a ratio of a number of said higher resolution destination data lines to be displayed to a number of said low resolution source data lines to be received by said receiving means; and means for evaluating a relative position of said low resolution source data line in combination with said ratio to determine area coverage of said one or more nearest neighboring higher resolution destination data lines by said low resolution source data line; and means for outputting said low resolution source data line from said storing means as each of said one or more nearest neighboring higher resolution data destination lines onto which said low resolution source data line has been mapped.

2. A signal processing system for translating a low resolution source scan line into one or more higher resolution destination scan lines which are displayed on a fixed frequency monitor in an IBM-compatible personal computer system comprising:

a first graphics processor for outputting said low resolution source scan line, wherein said low resolution source scan line is formatted in one of a group of video modes consisting essentially of: character mode, CGA, EGA, and VGA;

a monitor having a fixed frequency for displaying said one or more higher resolution destination scan lines;

a second graphics processor for outputting said one or more higher resolution destination scan lines to said monitor including:

clock select logic for receiving data corresponding to said fixed frequency; and processing means for translating said low resolution source scan line into said -one or more higher resolution destination scan lines by selecting said low resolution source scan line for output to said monitor as a higher resolution destination scan line, only if said low resolution source scan line maps onto a majority area of said higher resolution destination scan line using said data corresponding to said fixed frequency to calculate mapping of said low resolution source scan line onto said higher resolution destination scan line.

3. Apparatus for controlling display of image data representative of a first image made up of M lines of N pixels each in a display format having P lines of Q pixels each, M, N, P and Q being positive integers, P being greater than M and Q being greater than N, said apparatus comprising:

a source of said image data;

line creation means responsive to said source of first image data for creating additional image data for display of a plurality of additional display lines selectively adjacent a respective at least one of said M lines, wherein said line creation means creates said additional image data by replicating a nearest neighboring one of said M lines that covers a majority area of a corresponding one of said additional display lines, wherein said majority area covered is determined by said line creation means using the ratio P/M; and pixel horizontal expansion means, responsive to said source of image data and to said line creation means, for expanding data for N pixels to determine display of Q pixels.

4. A method for controlling display of image data representative of a first image made up of M lines of N pixels each in a display format having P lines of Q pixels each, M, N, P and Q being positive integers, P being greater than M and Q being greater than N, said method comprising the steps of:

determining a ratio of P/M;

receiving said image data;

creating additional image data for display of a plurality of additional display lines P selectively adjacent a respective at least one of said M lines, by replicating a nearest neighboring one of said M lines that covers a majority area of a corresponding one of said additional display lines as determined using said ratio P/M to calculate area of coverage; and expanding data for N pixels to determine display of Q pixels.

5. A signal processing system comprising:

a memory device for receiving video data;

a controller for receiving a signal which indicates when said video data is to be loaded into the memory, for generating an enable signal for writing said video data into said memory;

clock select logic for receiving a clock resolution select signal and outputting a frequency select signal which controls a clock generator such that a frequency of operation corresponding to a desired operating mode can be selected and for receiving a monitor resolution; and a RAMDAC which receives video data output from said memory and outputs RGB signals at a rate based on said desired operating frequency;

wherein said controller generates a gate signal by which said video data is output from said memory to said RAMDAC when said video data covers a majority area of a scan line to be output as said RGB signals as determined based upon a ratio of said monitor resolution to a resolution of said video data.

6. The system of claim 5 wherein said controller further comprises:

means for generating a flow signal which controls a rate at which said video data is written into said memory;

means for generating an enable signal which gates said video data into the memory device;

means for sending a reset signal to said memory device; and means for enabling the output of said video data from the memory to the RAMDAC.

* * * * *